US005461300A

United States Patent [19]

Kappenman

[11] Patent Number: 5,461,300

[45] Date of Patent: Oct. 24, 1995

[54] PHASE ANGLE REGULATING TRANSFORMER WITH A SINGLE CORE PER PHASE

[75] Inventor: John G. Kappenman, Duluth, Minn.

[73] Assignee: Electric Power Research Institute, Inc., Palo Alto, Calif.

[21] Appl. No.: 39,862

[22] Filed: Mar. 30, 1993

[51] Int. Cl.[6] ..... G05F 5/02

[52] U.S. Cl. ..... 323/215; 323/217

[58] Field of Search ..... 323/212, 215, 323/217; 363/64

[56] References Cited

U.S. PATENT DOCUMENTS

| | | | |
|---|---|---|---|
| 3,652,925 | 3/1972 | Yamana | 323/342 |
| 3,938,030 | 2/1976 | Cornwell | 323/253 |
| 3,938,031 | 2/1976 | Blackmond | 323/247 |
| 3,944,913 | 3/1976 | Kugler | 323/258 |
| 4,013,942 | 3/1977 | Boshnyaga et al. | 323/119 |
| 4,302,716 | 11/1981 | Glavitsch et al. | 323/217 |
| 4,469,997 | 9/1984 | Curtiss et al. | 318/729 |
| 4,477,760 | 10/1984 | Kuznetsov | 318/773 |
| 4,567,423 | 1/1986 | Dobsa et al. | 322/58 |
| 4,661,763 | 4/1987 | Ari et al. | 323/215 |
| 5,006,784 | 4/1991 | Sonntagbauer | 323/343 |
| 5,166,597 | 11/1992 | Larsen | 323/215 |
| 5,309,346 | 5/1994 | Gyugyi | 363/54 |

OTHER PUBLICATIONS

"Solid–State Tap Changer Applied as Fast Phase Shifter," *Study of Improved Load–Tap–Changing for Transformers and Phase–Angle Regulators,* EPRI EL–6079 Project 2763–1, Final Report, Nov., 1988, Section 4, pp. 4–1 to 4–7.

Ooi et al., "A Solid–State PWM Phase–Shifter," IEEE/PES 1992 Winter Meeting, New York, Jan. 1992, p. 1–7.

Baker et al., "Control Algorithm for a Static Phase Shifting Transformer to Enhance Transient and Dynamic Stability of Large Power Systems," *IEEE Transactions on Power Apparatus and Systems,* vol. PAS–101, No. 9, Sep. 1982, pp. 3532–3542.

Appendix A: A schematic block diagram of the Brown Boveri Corporation (BBC) design discussed in the Background portion of the Specification, circa 1981.

Arnold et al., "Transient Stability Improvement Using Thyristor Controlled Quadrature Voltage Injection," IEEE Transactions on Power Apparatus and Systems, vol. PAS–100, No. 3, Mar. 1981, pp. 1382–1388.

*Primary Examiner*—Peter S. Wong
*Assistant Examiner*—Y. Jessica Han
*Attorney, Agent, or Firm*—Flehr, Hohbach, Test, Albritton & Herbert

[57] ABSTRACT

A dynamic phase angle regulator for enhancing the transient stability of a three phase AC power system includes a controller, a switching assembly of thyristor switches, and a single transformer coupled to a power line. The transformer includes a balanced three phase configuration of exciting windings coupled to nodes at each phase of a three phase transmission system. Each phase of the transformer further includes a pair of regulating windings electrically coupled to the node and magnetically coupled to a corresponding exciting winding. Each exciting winding induces a voltage on the corresponding pair of regulating windings. To provide a selected phase shift, the controller actuates the switching assembly in response to a transient event to add a voltage induced on the regulating windings to the line voltage. A method is also provided for regulating the phase angle in a polyphase power transmission system.

5 Claims, 6 Drawing Sheets

PHASE ANGLE REGULATING TRANSFORMER WITH A SINGLE CORE PER PHASE

FIELD OF THE INVENTION

The invention generally relates to power regulation systems including a transformer and semiconductor switching control. More particularly, the invention relates to a dynamic phase angle regulator with semiconductor switching control for enhancing the static and dynamic performance of a power system.

BACKGROUND OF THE INVENTION

Power regulators are typically used to regulate power flow in power transmission systems that transfer power among utilities or between a utility and its consumers. The transmission system transfers alternating current ("AC") power through a polyphase transmission line, such as a three phase line with each phase having a voltage displaced in phase with respect to the other phases by 120°. A conventional power regulator is placed in series with the line between a source of power, such as a generator, and a load, such as the consumer(s) or another utility system, to control power flow.

By controlling power flow in the transmission line, the power regulator may improve the stability of the transmission system. Stability is the property of a power system that ensures that the system will operate in equilibrium under normal conditions, and quickly return to equilibrium after a disturbance. For example, when two utilities are linked together, the transmission system interconnecting the utilities becomes unstable if a generator in one of the utilities falls out of synchronism. Severe disturbances along the transmission line may alter the power flow in the line, causing the generators to lose synchronism, and the power system to become unstable.

Conventional power regulators address two forms of stability: steady state and transient stability. Steady state stability is concerned with slow or gradual fluctuations in power flow. Transient stability addresses severe disturbances in the power flow, such as those caused by sudden changes in the load, switching circuits, or fault conditions. Fault conditions may occur during high winds and storms when power lines break, become entangled, or become shorted to ground.

Power regulators enhance the capacity of a transmission system to transfer power without exceeding stability limits. The stability limit of a transmission system is the maximum amount of power flow that the system may transfer without experiencing a loss of stability. A system has a steady state limit for gradual fluctuations in the power flow, and a transient stability limit for abrupt changes in the power flow. An abrupt disturbance, such as a severe fault on the line, may create a low frequency power swing along the line. Low frequency power fluctuations may cause the system to exceed its transient stability limit. The practical result is that several generation stations may trip off line (shut down) in response to these fluctuations, and consequently cause cascading blackouts over entire regions. By regulating power flow among the systems, the occurrence of such regional blackouts may be reduced or avoided.

When interconnecting two or more utilities with a large phase angle difference between their respective transmission systems or networks, there are generally two viable alternatives for enhancing the stability of the network: back-to-back high voltage direct current ("HVDC") systems, and phase angle regulators. Back-to-back HVDC systems convert incoming AC power to direct current ("DC") power and then convert the DC power back to AC power. During this power conversion process, the back-to-back HVDC system may modulate the power transfer to damp any low frequency oscillations resulting from abrupt disturbances on the transmission line. While back-to-back HVDC systems provide acceptable steady state and dynamic control, they are very costly due to the expense of the power electronic converter and transformers included in the system.

The second alternative for enhancing network stability uses a phase angle regulator. Phase angle regulators may perform both steady state and dynamic control by modulating the phase angle in the transmission system to control power flow. Coupled to a controller which senses changes in power flow, the phase angle regulator compensates for these changes by adjusting the phase of the voltage between the source and load. In a balanced three-phase transmission line, the power delivered by a three phase source equals three times the average power in each phase. The average power in each phase is the product of the magnitudes of the line voltage and current and the power factor. The power factor is the cosine of the angle between the line voltage and current. A phase angle regulator shifts the phase angle of the voltage relative to the current to control power flow in the transmission line. The injection of the quadrature voltage results in a new line voltage shifted in phase from the original line voltage. Depending upon the magnitude and phase of the injected voltage, the phase angle regulator may increase or "boost" the voltage amplitude, decrease or "buck" the voltage amplitude, or simply provide a phase shift without significantly affecting the voltage amplitude.

In general, phase angle regulators inject a voltage by using transformers having two or more windings magnetically coupled together. Current passing through a primary winding of the transformer induces a current in, and a voltage across, a secondary winding. The induced voltage and current are related to the primary voltage and current by the turns ratio between the primary and secondary windings. Using this basic principal, the phase angle regulator typically has a first transformer which obtains a voltage from one phase of a transmission line, and a second transformer which adds the voltage to another phase of the line. One phase of the primary winding of the first transformer is typically coupled in parallel with one phase of a polyphase transmission line, and the secondary winding of the second transformer is typically coupled in series with another phase of the transmission line. A secondary winding of the first transformer is coupled to the primary winding of the second transformer to inject a voltage in series with a phase of the transmission line. In such systems, the magnitude of voltage injected may be adjusted by altering the turns ratio of the windings. To alter the number of turns in a winding, conventional phase angle regulators have a switching mechanism, called a "load tap changer," to switch among contacts, called "taps," along the winding.

Conventional phase angle regulators provide steady state control. Typically, such conventional systems use mechanical load tap changers that are significantly less costly than the power electronics used in back-to-back HVDC systems. One significant drawback of these conventional systems is the lack of adequate dynamic phase angle regulation because mechanical tap changers cannot switch fast enough to respond to abrupt disturbances in the transmission system. When switched quickly, the mechanical tap changers generate high losses which are manifested in arcing. As a consequence, conventional phase angle regulators are not capable of providing suitable dynamic phase angle regulation.

To address this drawback, conventional phase angle regulators use semiconductor switching devices, such as thyristors, capable of very fast switching with very low losses. Such semiconductor switch devices are known as "static" devices for their lack of physical motion as compared to mechanical tap changers. One should not confuse this terminology with the term "dynamic," which refers to the very rapid phase shifting performed by phase angle regulators. With thyristor control, phase angle regulators can provide both steady state and dynamic phase angle regulation necessary to regulate power flow and maintain the stability of interconnected power systems.

However, as with back-to-back HVDC systems, the hardware in these earlier thyristor controlled phase angle regulators is very expensive. Both the physical size and cost of the components are directly related to the through-current rating of the transmission line and its rated voltage. If the phase angle regulator is to provide continuous steady state control, then the components must be rated for continuous full load current operation. If such a steady state phase angle regulator is to provide phase angle regulation during a fault, then the components must be rated to withstand much higher voltage stresses and fault current levels. Finally, the components in such phase angle regulators must have ratings roughly proportional to the maximum phase angle because higher phase angles require the injection of higher voltages, which places more stress on switching components. Because steady state regulators must operate continuously and must provide large phase shifts, the regulator components require higher ratings, and consequently, are more expensive.

One earlier thyristor controlled phase angle regulator was proposed in 1982 by R. Baker, then of Washington State University, and G. Güth, then of the Brown Boveri Corporation, and is referred to herein as "the BBC regulator." While the BBC regulator provides the necessary stability enhancement, it is not cost effective for many applications because it includes costly power electronics and two separate transformers. The BBC regulator has a first transformer with primary windings coupled between each phase of a three phase system, and a secondary winding for each primary winding. Each phase of the secondary winding has coil segments with a 1:3:9 turns ratio relative to each primary winding.

The BBC regulator has a bank of thyristor switches which selectively couple the secondary windings of the first transformer to primary windings of the second transformer. The second transformer includes secondary windings coupled in series with respective phases of the transmission line. By switching a coil segment of the secondary of the first transformer, the phase angle regulator may inject a range of discrete voltages at the second transformer in series with the transmission line. This range of discrete voltages provides smooth transitions over the entire range of operation, and thus, is known as "vernier" phase angle regulation.

While the BBC regulator is superior to conventional phase shifters because it provides dynamic phase angle regulation, the hardware included in the BBC system makes it unduly expensive. Both the large number of thyristors included in the BBC switch bank, and the two separate transformers, increase the cost of the BBC design. Each of the BBC thyristors must be rated for continuous operation if the BBC regulator is to provide both steady state and dynamic control. Moreover, the two separate transformers in the BBC design each require separate cores and tanks. For moderate to larger phase angle differences, on the order of 25° or greater, the BBC system can be as costly or more expensive than the back-to-back HVDC systems. For small phase angle differences, in the range of 25° or less, the BBC static phase shifter has a cost advantage over the back-to-back HVDC system.

SUMMARY OF THE INVENTION

A phase angle regulation system can be configured in various embodiments to be cost effective and efficient by using the phase angle regulator of the present invention either alone or in combination with conventional phase shifters. When used alone, the regulator of the present invention may be used for providing transient regulation in systems that normally do not require steady state phase angle regulation. When used in combination, the conventional phase angle regulators provide steady state phase angle regulation for interconnecting systems with phase angle differences, while the regulator of the present invention provides dynamic phase angle regulation.

According to one aspect of the present invention, a dynamic phase angle regulator is provided for regulating power flow through a polyphase AC power line having one line per phase. The regulator has a transformer unit with a polyphase core having a core element per phase. The transformer unit has a regulating winding, and an exciting winding for coupling to a first line of the AC power line, with the regulating winding and the exciting winding being wound around a first core element. The regulator also has a switching assembly coupled to the regulating winding for selectively coupling the regulating winding in series with a second line of the AC power line to inject a regulating voltage in the second line.

According to another aspect of the present invention, a method is provided for regulating a phase angle in an AC power line of a power transmission system. The method comprises the steps of providing an exciting transformer having an exciting winding and a regulating winding wound around a common core element. In a coupling step, the exciting winding is coupled to the line to energize the regulating winding though magnetic coupling. In a sensing step, a disturbance in the transmission system is sensed. In response to the sensing, a static switching assembly is actuated to selectively couple at least a portion of the regulating winding in series with the line for regulating the phase angle.

In an illustrated embodiment, a phase angle regulator according to the invention includes thyristor switching control and a single exciting transformer. The exciting transformer includes a balanced three phase configuration of exciting windings each wound around a single phase of the core structure so each exciting winding is magnetically coupled with a pair of corresponding regulating windings. At each phase, a pair of regulating windings is electrically coupled to an exciting winding node. The regulating windings may be switched in series with power flow through the system.

During normal operation, current bypasses the regulating windings, yet energizes the three exciting windings because the exciting windings are coupled to the three phase transmission line at each node. The bypass path may be provided through bypass thyristors or a mechanical bypass switch. In rapid response to a fault in the system, a controller opens the bypass switch, or turns off the bypass thyristors, and turns on thyristor valves that couple the regulating windings in series with power flow. The energized exciting windings, which are typically phase displaced with respect to the corresponding regulating windings, induce a voltage across the corresponding regulating windings. The thyristors remain on for only a brief period to inject a single quadrature voltage and thus a discrete phase shift to the transmission system. The firing of the thyristors is controlled to avoid harmonics and to produce a desired voltage buck, boost, or phase shift.

This dynamic phase angle regulator provides significant advantages over earlier phase angle regulators. This regulator requires only a single transformer and a minimum number of semiconductor switches to provide dynamic phase angle regulation. Only a minimal number of semiconductor switches must be rated for short circuit duty and continuous operation, because most of the switches are only actuated briefly when responding to a disturbance in the transmission system. This dynamic regulator provides phase angle regulation performance which is similar to existing phase shifters, yet it is significantly less costly because it requires less, and lower rated, hardware.

An object of the invention is to provide a low-cost dynamic phase angle regulator to address the drawbacks of earlier phase angle regulators while increasing the transient stability of the power transmission system.

Another object of the invention is to provide a dynamic phase angle regulator having high speed power electronics to rapidly inject a discrete phase shift into a power line in response to a transient disturbance in the power system.

A further object of the invention is to minimize the cost and number of components in a dynamic phase angle regulator having power electronic switching control.

The present invention relates to the above features and objects individually as well as collectively. These and other objects, features, and advantages of the invention will become apparent to those skilled in the art from the following description and drawings.

DETAILED DESCRIPTION OF THE PREFERRED EMBODIMENTS

Figure 1:
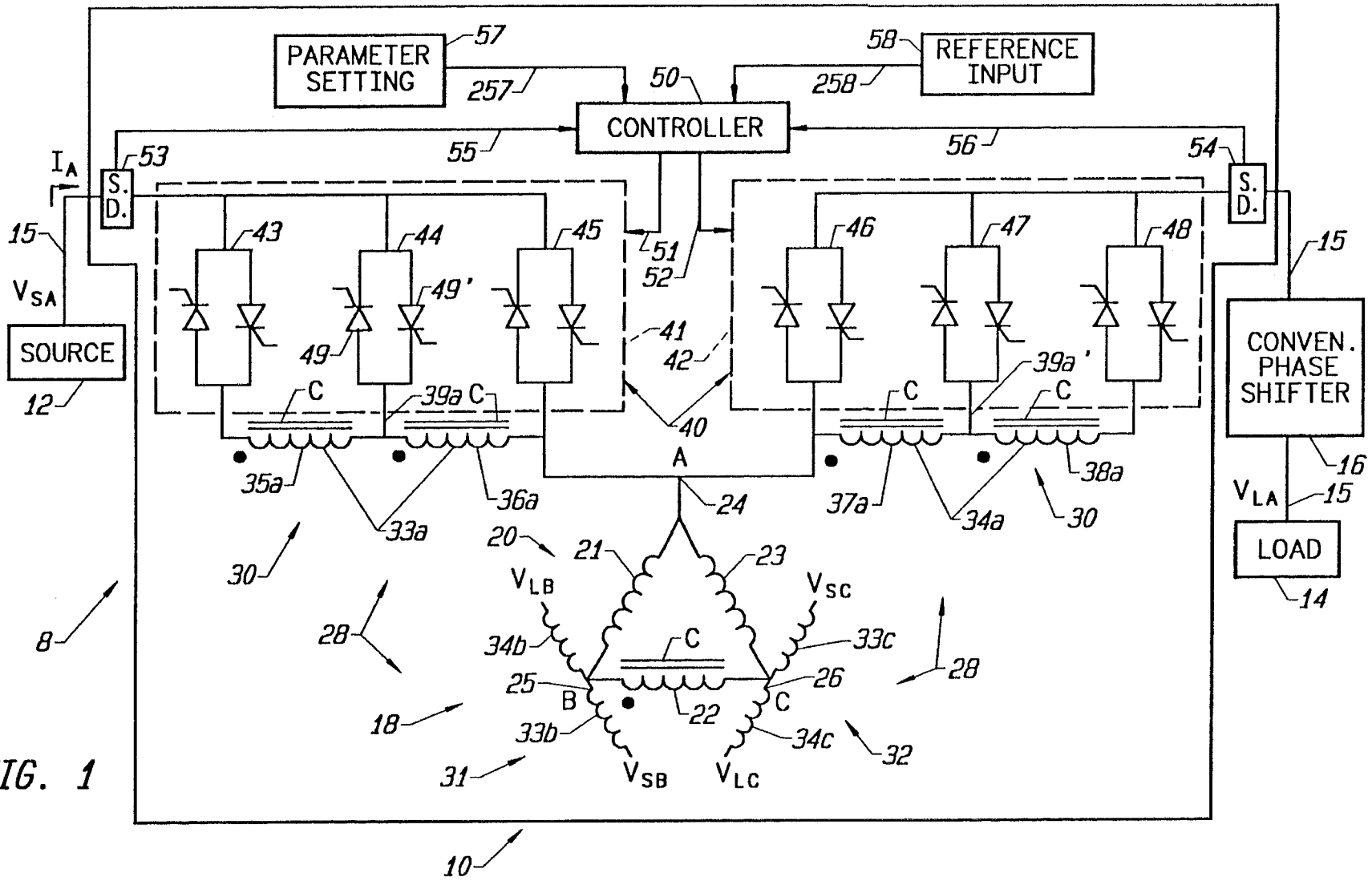
FIG. 1 is a schematic block diagram of a first form of a dynamic phase angle regulator system of the present invention.

FIG. 1 illustrates an embodiment of a dynamic phase angle regulation system 8, including a dynamic phase shifter or phase angle regulator 10, constructed in accordance with the present invention. The regulator 10 is capable of providing unidirectional phase shifts between zero and a maximum value. For instance, maximum phase shifts up to around 45° or greater may be required for some implementations. A 30° maximum angle is described herein by way of example only, and it is apparent that maximums values below 30° may also be used. The dynamic phase angle regulator 10 regulates power flow in an AC polyphase transmission system 11, including a power source 12, such as a generation station, and a load 14. The source 12 and load 14 are coupled together by a power transmission line, such as a three phase transmission line 15 which has three phases labeled A, B, and C. The dynamic regulator 10 is coupled in series with the line 15. For convenience, FIG. 1 illustrates only phase A in detail, and it is apparent that phases B and C each have similar structure.

While the regulator 10 is shown coupled between a source 12 and load 14, it is apparent that the terms "source" and "load" are used herein for convenience only. The source 12 and load 14 are interchangeable, and each could represent a utility system, drawing or producing power, or a network of utility customers consuming power transmitted over line 15.

The regulator 10 may be used alone to provide phase angle regulation in response to abrupt disturbances along the line 15. For example, in systems without a phase angle difference, the regulator 10 may be used to transiently regulate or modulate power flow across two points. Alternatively, the phase angle regulation system 8 may include a conventional phase shifter or phase angle regulator 16 used in series with the regulator 10. In this embodiment, the conventional phase shifter 16 provides steady state regulation, while the regulator 10 provides dynamic phase angle regulation. One suitable conventional phase shifter 16 is the steady state phase angle regulator with a mechanical load tap changer, such as the BBC regulator described in the Background portion above.

The phase angle regulator 10 has a polyphase transformer, such as a three phase transformer unit 18. The transformer 18 preferably has a single, three-phase core structure C, comprising a single core element for each phase, which may be constructed in a conventional manner as known to those skilled in the art. The transformer unit 18 is preferably housed within a single tank (not shown). The transformer 18 has a balanced set of delta connected exciting windings 20, including three exciting windings, specifically the line-to-line AB, BC and CA windings 21, 22 and 23. The exciting windings 21, 22 and 23 are coupled together at phase A, B and C nodes 24, 25 and 26, as shown in FIG. 1.

The transformer unit 18 has a balanced set of regulating windings 28, comprising phase A, B and C windings 30, 31 and 32 for selectively coupling in series with the respective phases A, B and C of the line 15. Each phase of the regulating windings 30, 31, 32 has a pair of regulating coils 33 and 34 coupled together at the respective phase node of the transformer, and designated by a lower case letter representing the phase. For example, the phase A regulating winding 30 includes first and second coils 33*a* and 34*a*.

Preferably, the regulating coils for each phase are divided into two or more coil segments. For example, the coil 33*a* is divided into two coil segments 35*a* and 36*a*, and coil 34*a* is divided into coil segments 37*a* and 38*a*. The coil segments 35*a* and 35*b* have a tap 39*a* therebetween, and segments 37*a* and 37*b* have a tap 39*a* ' between them, for varying the current path through the regulating winding 30 as described further below. Additional taps (not shown) may be provided along the coils 33 and 34 as required for particular implementations of the regulation system 8. For clarity, the coil segments 35–38 and taps 39, 39' have not been separately shown for the phase B and C regulating windings 31 and 32, although it is apparent they may be constructed as shown for phase A.

The magnetic coupling of the set of regulating windings 28 with the set of exciting windings 20 is illustrated for phase A of the regulating windings using conventional dot notation. The phase BC exciting winding 22 is magnetically coupled to the phase A regulating winding 30 by winding the these windings 22 and 30 around a common core element. The heavy black dots located adjacent the B phase end of the phase BC exciting winding 22, and adjacent the first ends of the coil segments 35*a*, 36*a*, 37*a* and 38*a*, indicate that these windings are wound around one of the core elements so these ends share the same instantaneous polarity. Current passing through the BC exciting winding 22 induces a voltage in the regulating winding 30. The induced voltage is proportional to the turns ratio between winding 22 and the coil segment(s) 35*a*, 36*a*, 37*a* and/or 38*a* through which the line current $I_A$ is switched to flow, as described further below.

Referring to phase A, the dynamic phase angle regulator 10 includes a switching assembly unit 40 coupled in series with the transmission line 15. The switch unit 40 has a pair of switch assemblies 41 and 42, coupled together at the phase A node 24, for selectively coupling the respective regulating coils 33*a* and 34*a* in series with the line 15. The first assembly 41 has three semiconductor switching devices, such as three thyristor valves 43, 44 and 45, while the second assembly 42 has three semiconductor switching devices, such as three thyristor valves 46, 47 and 48. Each thyristor valve 43–48 comprises a pair of antiparallel thyristors 49 and 49', as illustrated for valve 44 While only shown coupled to phase A, it is apparent that the switch assembly unit 40 also' has assemblies (not shown) constructed as shown for assemblies 41 and 42 coupled to the phase B and C portions of line 15.

It is apparent that the assemblies 41 and 42 may have other numbers, combinations and types of switching devices, a few examples of which are illustrated below. For the purposes of a dynamic phase angle regulation, thyristor valves are preferred because they may be switched on and off very rapidly in response to the presence or absence of a triggering gate current. It is apparent that gate turn-off thyristors (GTO's) and other structurally equivalent switch devices known to those skilled in the art may be substituted for the thyristors illustrated herein. Thyristors also conduct continuously as the current through the switch drops to zero. Because of this characteristic, the thyristors in antiparallel may conduct for an entire sine wave with each thyristor conducting for a half cycle.

The switching unit 40 may be coupled to the set of regulating windings 28 as illustrated for phase A in FIG. 1. For the first switch assembly 41, valve 43 is coupled to a first end of coil segment 35*a*, valve 44 is coupled to tap 39*a* at the junction of a second end of segment 35*a* and a first end of coil segment 36*a*, and valve 45 is coupled to a second end of segment 36*a*. For the second switch assembly 42, valve 46 is coupled to a first end of coil segment 37*a*, valve 47 is coupled to tap 39*a* ' at the junction of a second end of segment 37*a* and a first end of coil segment 38*a*, and valve 48 is coupled to a second end of segment 38*a*.

The thyristor valves 45 and 46 may also be referred to as bypass thyristor valves, since when they conduct and the remaining valves 43, 44, 47 and 48 do not conduct, the line current effectively bypasses the phase A regulating windings 30. However, the exciting winding set 20 continues to extract a voltage from the phase A, B and C nodes 24, 25 and 26, which may induce currents that circulate through the exciting windings 21, 22 and 23 even when the regulating windings 30, 31 and 32 are bypassed by the switching unit 40.

The configuration of switches shown in FIG. 1 minimizes the number and rating of the thyristors required to provide dynamic phase angle regulation. Only the bypass valves 45 and 46 are rated for continuous operation and short circuit duty. The other valves 43, 44, 47 and 48 only operate during dynamic angle regulation, and may be rated for ten-second short circuit operation and normal duty. The voltage rating for the full regulation valves 43 and 48 directly relates to the maximum phase shift of the regulator 10 because the phase shift relates in part to the magnitude of voltage across the regulating windings.

Figure 2:
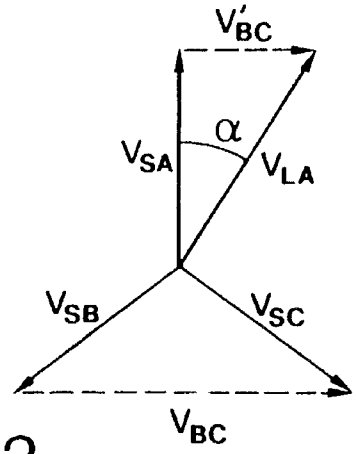
FIG. 2 is a phasor diagram illustrating the phase shift induced using the dynamic phase angle regulator of FIG. 1.

To more clearly illustrate a method in accordance with the present invention of regulating the phase angle of the power flow through line 15, FIG. 2 illustrates a phasor diagram that shows the relationship between the injected voltage, $V_{BC}'$, and a resulting phase voltage, $V_{LA}$. When the phase A regulating winding 30 is coupled in series between the source 12 and the load 14, the $V_{BC}'$ voltage induced in winding 30 by the magnetic coupling with the $V_{BC}$ voltage along the phase BC exciting winding 22, is added to the voltage at the source, $V_{SA}$. The injection of this $V_{BC}'$ voltage produces a new voltage at the load, $V_{LA}$, which is shifted in phase by an angle $\alpha$ from the source voltage $V_{SA}$ received by the regulator 10.

Using this principle, and by controlling the timing of the voltage injection relative to the line voltage waveform, the regulator 10 may inject a discrete phase shift into the phase voltages of line 15. It is apparent that a phase shift may be similarly induced in each or all phases of the transmission system, or only in selected phases of the line 15. The magnitude of the discrete steps in phase shift depends, in part, on the number of taps 39, 39' and their location along the regulating windings 30, 31 and 32. Selecting the taps through which the line current flows effectively varies the turns ratio between the exciting winding and the regulating winding, and thus, varies the voltage induced on the regulating windings 30, 31 and 32.

When the valves 43 and 48 conduct, and the remaining valves 44, 45, 46 and 47 do not conduct, the regulator provides a maximum phase shift because the line current passes through the entire regulating winding 30. By allowing the intermediate valves 44 and 47 to conduct, while the remaining valves 43, 45, 46 and 48 do not conduct, the regulator provides an intermediate phase shift by allowing the line current to pass through coil segments 36*a* and 38*a*. It is apparent that the line current may be similarly routed through the switching unit 40 for each phase, or different paths may be used for each phase, as well as different timing strategies for introducing the shifts into each phase.

Regarding the timing of firing, each of the thyristors 43–48 may be selectively fired at the zero crossing of the AC current at the device to avoid producing undesirable harmonics in the transmission line 15. To provide more continuous phase angle control, the thyristors 43–48 may be selectively triggered into a conducting state for only a fraction of a cycle. Such continuous firing angle control allows the phase angle regulator 10 to provide any phase shift between zero and the maximum phase shift capacity of regulating winding set 28.

For example, if the dynamic regulator 10 was constructed to have a maximum phase shift of 20° , fire angle control would enable the dynamic regulator to inject any phase shift from 0° to 20° . For only a first fraction of a half cycle, the thyristors 43 and 48 conduct, and then the bypass thyristors 45 and 46 conduct for the remaining fraction of the half cycle. The magnitude of the phase shift relates to the fraction of each half cycle during which the thyristors 43 and 48 conduct: a short conduction time corresponds to a small phase shift, and conversely, conduction through the entire half cycle corresponds to the maximum phase shift. The duration of the conduction time for the thyristors 43 and 48 may be suitably controlled to provide the desired phase shift. One drawback to firing angle control is the side effect of producing undesirable harmonics in the transmission line 15 when the thyristors 43, 45, 46, 48 conduct for only a fraction of a half cycle.

The dynamic regulator 10 also has a controller 50 which supplies thyristor triggering or firing signals 51 and 52 to the respective switch sub-assemblies 41 and 42 to selectively activate the thyristor valves 43–48. The controller 50 operates in response to an input or source power parameter sensor 53 and an output or load power parameter sensor 54. The sensor devices (S.D.) 53 and 54, which may be conventional sensor devices (S.D.), are preferably coupled to the regulation system 8 local to the regulator 10 to monitor the respective incoming and outgoing power parameters.

The power parameters monitored by sensors 53 and 54 may be the line current, the phase-to-phase or the line-to-neutral voltage, the real power, the reactive power, the system frequency, changes in the system frequency, or the power factor of the line 15, source 12 or load 14. The source sensor 53 generates an input or source sensor signal 55 in response to the input parameters monitored, while load sensor 54 generates an output or load sensor signal 56 in response to the output parameters monitored. The regulator 10 also has a parameter setting routine or device 57 and a reference input routine or device 58 which supply input to the controller 50, as described further below. While only shown coupled to phase A, it is apparent that the sensors 53 and 54, and controller 50 also have components (not shown) coupled to phase B and C portions of line 15.

In operation, FIG. 1 illustrates in block diagram fashion the control of the phase angle regulator 10. To control the actuation of the switching assemblies 41 and 42, the controller 50 receives sensor signals 55 and 56 from sensors 53 and 54. The controller 50 may use signals 55 and 56 to detect changes in power flow, frequency, and/or voltage over time, or to detect abrupt changes which exceed threshold limits which may be set by the parameter setting device 57 and/or the reference input device 58. In addition, the controller 50 continually monitors power flow and voltage. It should be noted that the controller sensors 53, 54 may also be located locally at either the load or source side of the regulator 10, rather than at both locations as illustrated. In response to transient disturbances on the transmission line 15, the controller 50 may be programmed in a manner well known by those skilled in the art to regulate the power flow by providing firing signals 51 and 52 to divert the line current through selected portions of the regulating winding set 28 to provide selected phase shifts.

Second Embodiment

Figure 3:
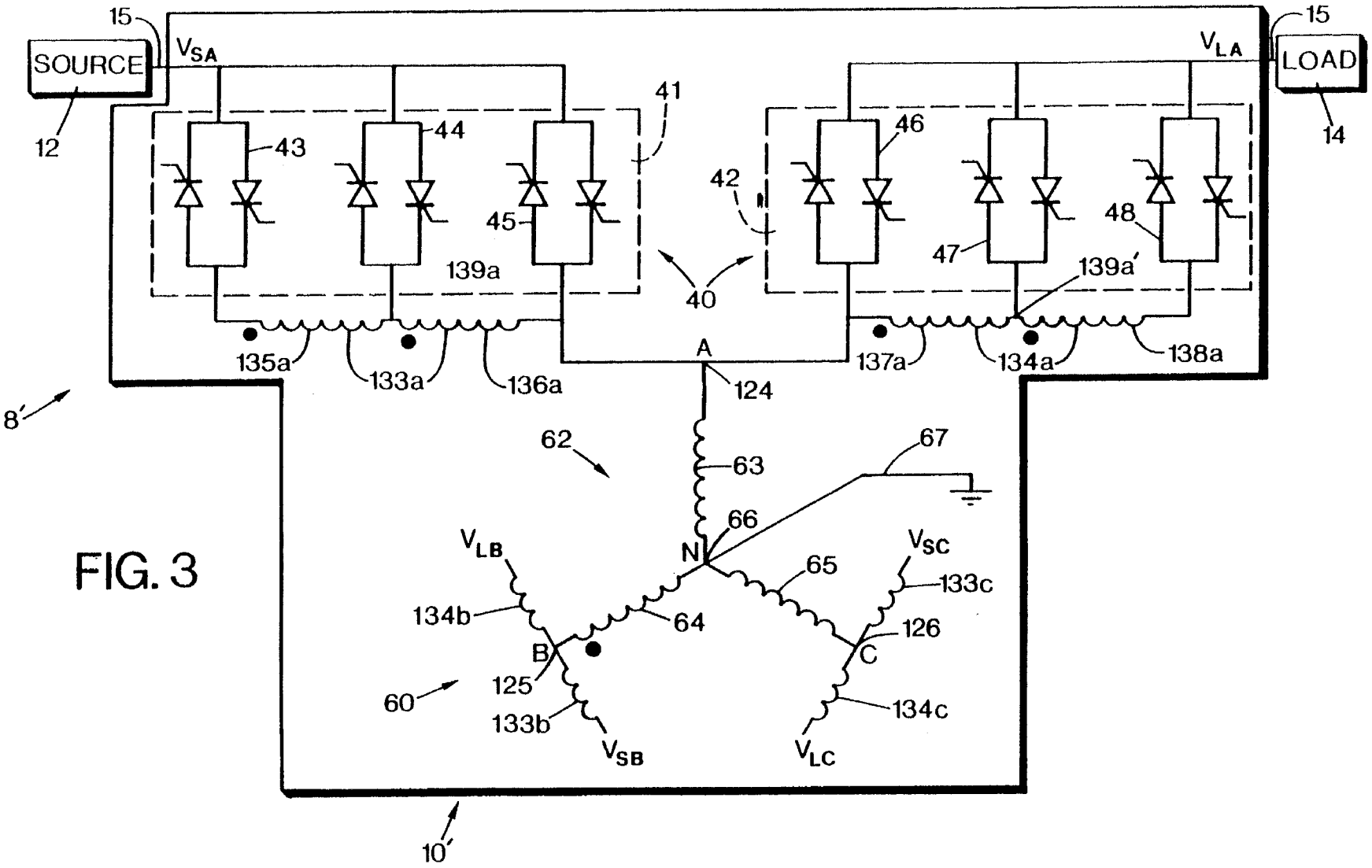
FIG. 3 is a schematic block diagram of a second form of a dynamic phase angle regulator system of the present invention, which includes wye-connected exciting windings.

Referring now to FIG. 3, a second embodiment of the regulation system 8' is shown having a second embodiment of a dynamic phase shifter or phase angle regulator 10', constructed in accordance with the present invention. The regulator 10' may be as described above for regulator 10 of FIG. 1, except the delta connected transformer unit 18 has been replaced with a grounded wye transformer unit 60. For clarity, the optional conventional phase shifter 16, the controller 50, sensors 53 and 54, the parameter setting device 57, and the reference input device 58 have been omitted from the FIG. 3 illustration, but their location and operation may be as described above.

The transformer unit 60 has a set of regulating windings which may be as described above for the regulating winding set 28 in FIG. 1. Thus, the regulating windings and phase A, B, C nodes of the transformer 60 embodiment have like components numbered exactly one hundred more than their respective FIG. 1 embodiment counterparts. For example, the first phase A coil **133*a* is divided into two coil segments 135*a* and 136*a***.

The transformer 60 has a grounded wye set of exciting windings 62 including phase AN, BN and CN exciting windings 63, 64, and 65, respectively, coupled together at an N neutral node 66. A conductor 67 couples the neutral node 66 to ground. The other ends of the AN, BN and CN exciting windings 63, 64, and 65 are coupled to the respective phase A, B, and C nodes 124, 125 and 126. This particular configuration may be used for higher voltage applications, such as 161 kV and 230 kV, where the cost of the wye configuration exciting transformer may be less expensive than the delta configuration at these particular voltages.

Third Embodiment

Figure 4:
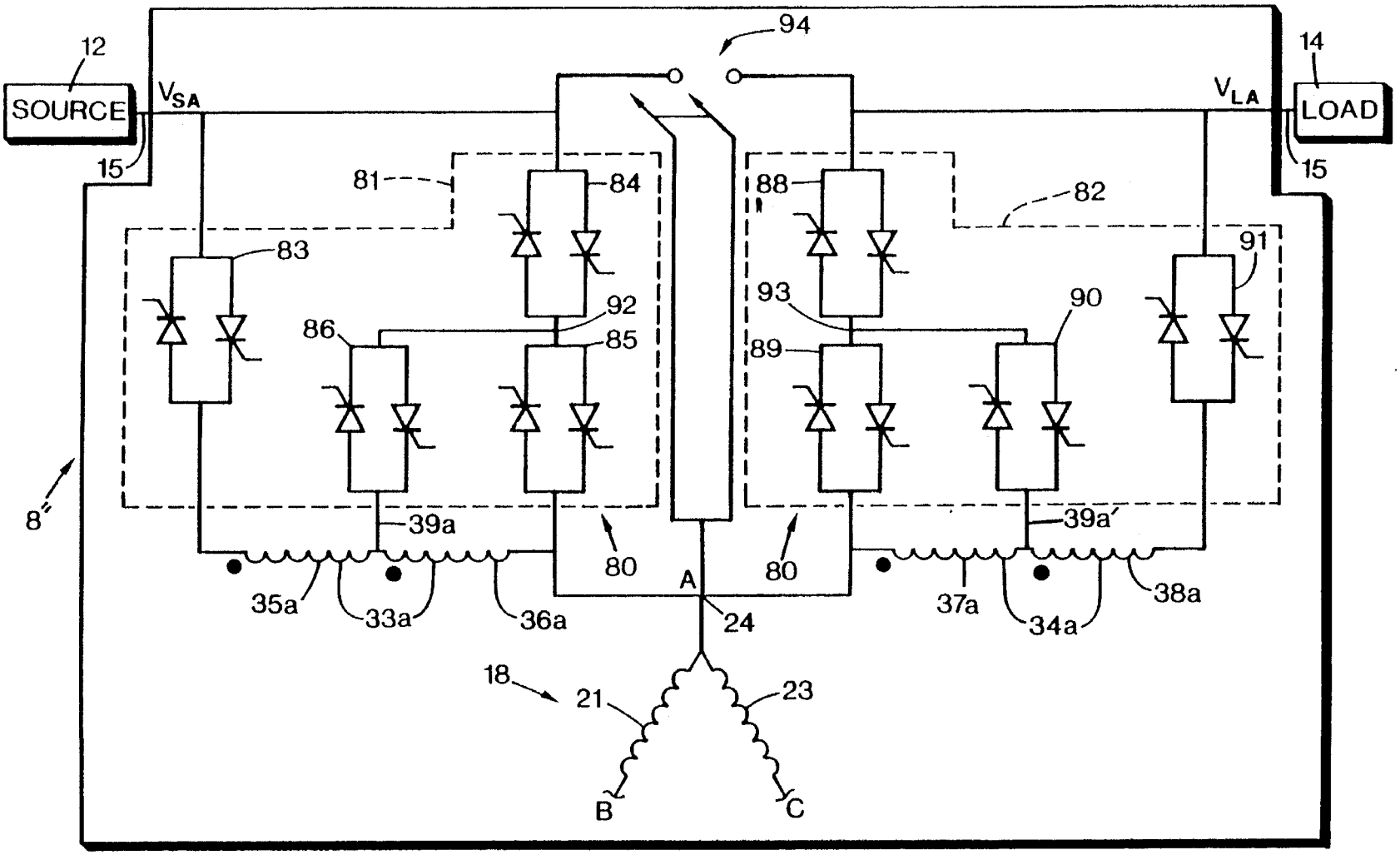
FIG. 4 is a schematic block diagram of a third form of a dynamic phase angle regulator system of the present invention.

Referring now to FIG. 4, a third embodiment of the regulation system 8" is shown having a third embodiment of a dynamic phase shifter or phase angle regulator 10", constructed in accordance with the present invention. The regulator 10" is capable of providing unidirectional phase shifts between zero and the maximum phase shift value, illustrated here as 30° . The regulator 10" may be as described above for regulator 10 of FIG. 1 as shown, or it may use the wye transformer unit 60 shown in FIG. 3, except that the switching assembly unit 40 has been replaced with an alternate switching assembly unit 80. For clarity, the optional conventional phase shifter 16, a portion of the transformer unit 18, the controller 50, the sensors 53 and 54, the parameter setting device 57, and the reference input device 58 have been omitted from the FIG. 4 illustration, but their location and operation may be as described above.

The switch unit 80 has a pair of switching assemblies 81 and 82 for selectively coupling the regulating winding set 30 to the line 15 as described above with respect to FIG. 1, except the current paths through the assemblies 81 and 82 differ from those shown in FIG. 1. The first assembly 81 has four semiconductor switching devices, such as thyristor valves 83, 84, 85 and 86, while the second assembly 82 has four semiconductor switching devices, such as thyristor valves 88, 89, 90 and 91. Each thyristor valve 83–91 comprises a pair of antiparallel thyristors, which may be as described above valves 43–48. The valves 84 and 85 are coupled in series at a switch node 92, and valve 86 is also coupled to node 92. The valves 88 and 89 are coupled in series at a switch node 93, and the valve 90 is also coupled to the node 93. While only shown coupled to phase A, it is apparent that the switch assembly unit 80 also has assemblies (not shown) coupled to the phase B and C portions of line 15 which may be constructed as illustrated for assemblies 81 and 82.

The switching unit 80 may be coupled to the set of regulating windings 28 as illustrated for phase A in FIG. 4. For the first switch assembly 81, valve 83 is coupled to the first end of coil segment 35*a*, valve 86 couples node 92 to tap 39*a*, and valve 85 couples node 92 to the second end of segment 36*a*. For the second switch assembly 82, valve 89 couples node 93 to the first end of coil segment 37*a*, valve 90 couples node 93 to tap 39*a*', and valve 91 is coupled to the second end of segment 38*a*.

The thyristor valves 84, 85, 88 and 89 may also be referred to as bypass thyristor valves, since when they conduct and the remaining valves 83, 86, 90 and 91 do not conduct, the line current effectively bypasses the phase A regulating windings 30. However, the exciting winding set 20 continues to extract an excitation voltage from the phase A, B and C nodes 24, 25 and 26. In some implementations, the bypass thyristors may be unable to efficiently conduct the small levels of exciting current required to supply the transformer.

To alleviate this potential problem, the regulator 10' may include an optional steady state bypass switch, such as a conventional mechanical double pole, single throw switch 94 illustrated in FIG. 4. During steady state conditions, the switch 94 may couple phases A, B and C of the line 15 to the respective A, B and C nodes 24, 25, 26 of the excitation winding set 20, as shown for phase A in FIG. 4. Using the bypass switch 94 reduces losses, and may even reduce the ratings of the regulator components in some cases. Moreover, the switch 94 allows the excitation transformer to remain coupled to, and energized by, the line 15 during steady state conditions, so introduction of a phase shift will not of itself create a further disturbance. It is apparent that regulators 10 and 10' of FIGS. 1 and 3 may also be equipped with a bypass switch (not shown), as described for FIG. 4.

The switching assembly unit 80 may be controlled to vary the current paths through the valves and the regulating winding set 28 to create various phase shift states on the line 15. In the FIG. 4 illustrated embodiment, phase shifts of 0°, 4.13°, 8.2°, 16.1°, 19.84° and 30° may be obtained, with differential firing being required to obtain the 4.13°, 16.1° and 19.84° shifts. For example, to obtain the 16.1° phase shift, the current path, for example through phase A, is through valve 83, coil segments 35*a* and 36*a*, and valves 88 and 89.

For non-differential firing in FIG. 4, the phase shift angle depends upon the turns ratio of the transformer unit 18, and the relative location of the taps 39 and 39', and the current path through the regulator 10". For example, to obtain the +8.2° phase shift, the phase A line current flows through valves 84 and 86, coil segments 36*a* and 37*a*, and valves 90 and 88.

It is preferred to configure the assembly unit 80 so as to minimize the overall current, voltage and MVA rating of the switches 83–91. The ratings of devices used in AC power transmission are typically measured in MVA (mega volt-amperes at a specified power factor), reflecting that, in AC systems, losses and heating are dependent upon voltage and current rather than strictly real power measured in watts. With increasing MVA rating, the size and cost of components increases. As such, for a given number of phase shift states, the phase angle regulator 10' preferably has a minimum number of thyristors requiring high MVA, voltage, and current ratings.

The configuration of switches shown in FIG. 4 minimizes the number and rating of the thyristors required to provide dynamic phase angle regulation. For example, for a 115 kV line-to-line voltage system, with a 150 MVA through flow rated regulator with a maximum phase shift of 30°, the per unit ("p.u.") voltage rating of the valves are as follows: the full regulation valves 83 and 91 are each rated at 1.0 p.u.; the first bypass valves 84 and 88 are rated at 0.75 p.u. and the second bypass valves 85 and 89 are rated at 0.25 p.u.; and the intermediate regulation valves 86 and 90 are rated at 0.25 p.u. The rating of the coil segments 35 and 38 is 753 Amps and 14.37 kV, resulting in a per unit rating of 0.75 p.u. The rating of the coil segments 36 and 37 is 753 Amps and 4.79 kV, resulting in a per unit rating of 0.25 p.u. The per unit representation illustrates that the total per unit rating of any current path between line 15 and the regulating windings 30 is 1.0 p.u.

For example, for the dynamic phase angle regulator 10" to provide 0°–30° of unidirectional phase shift, the thyristors and transformer have the following ratings. The total thyristor voltage rating is 4.5 p.u. and 86 kV. The minimum thyristor current and MVA ratings are 753 A and 230 MVA, respectively for 10 second operation. Finally, the transformer rating is 86 MVA, also for 10 second operation. This is only one example of the possible configuration and voltage rating of regulator 10", which accommodates various design cost tradeoffs and/or continuous operation capabilities. It should be understood that the number, configuration and rating of switching devices could change depending on, for example, the amount of phase shift, the number of phase shift states, and the operating time of the regulator 10".

Fourth Embodiment

Figure 5:
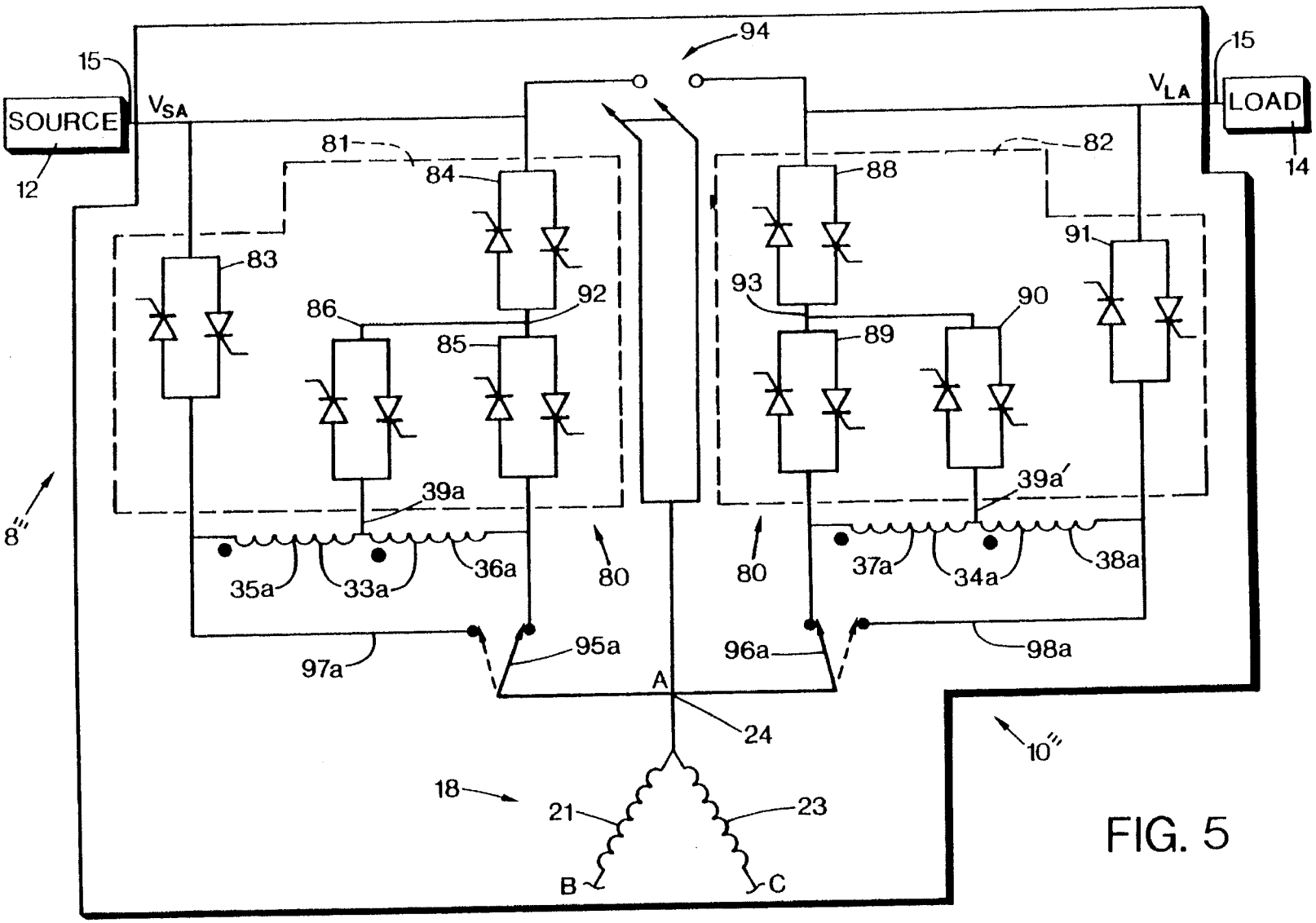
FIG. 5 is a schematic block diagram of a fourth form of a dynamic phase angle regulator system of the present invention which provides a bidirectional phase shift using mechanical switches.

Referring now to FIG. 5, a fourth embodiment of the regulation system 8"' is shown having a fourth embodiment of a dynamic phase shifter or phase angle regulator 10"', constructed in accordance with the present invention. The regulator 10"' is capable of providing bidirectional phase shifts from 0° to −30° or from 0° to 30°. The regulator 10"' may be as described above for regulator 10" of FIG. 4 as shown, or it may use the wye transformer unit 60 shown in FIG. 3. For clarity, the optional conventional phase shifter 16, a portion of the transformer unit 18, the controller 50, the sensors 53 and 54, the parameter setting device 57, and the reference input device 58 have been omitted from the FIG. 5 illustration, but their location and operation may be as described above.

The regulator 10"' differs from the regulator 10" of FIG. 4 by including a pair of "fast" mechanical reversing or diverter switches 95 and 96 for each phase. For example, the phase A first diverter switch 95*a* selectively couples the phase A node 24 with the first end of the coil segment 35*a* via a diverting conductor 97*a*. The second diverter switch 96*a* selectively couples the phase A node 24 with the second end of the coil segment 38*a* via a second diverting conductor 98*a*. Thus, conductors 97*a* and 98*a* may be selectively placed in the current path to draw current through, or divert current around, the respective coils 33*a* and 34*a* to selectively provide bidirectional phase angle regulation.

The switches 95 and 96 derive their "fast switch" name from their capability to actuate quickly relative to traditional mechanical load tap changer switches because switches 95, 96 need only move one step, rather than the multi-steps of usual practice with mechanical load tap changing style transformers or phase shifters. These mechanical switches 95 and 96 preferably have a response time within a few cycles of the transmission line voltage. While not as fast as solid state switches, the mechanical switches 95, 96 provide a low cost alternative where rapid actuation is not critical for performance. For example, referring briefly back to FIG. 4, the phase angle regulator 10" is illustrated as including the mechanical switch 94 for bypassing the regulator 10" during steady state conditions.

In FIG. 5, the mechanical diverter switches 95 and 96 are used to alter the path of the line current through the regulating winding set 28 to provide either a positive or a negative phase shift in response to a diverter switch signal (not shown) which may be supplied by the controller 50. Since these switches 95 and 96 are not capable of high speed actuation, the phase angle regulator 10''' of FIG. 5 cannot provide high speed bi-directional polarity. Even so, the regulator 10''' can provide phase shifts of −30°, −18.75°, −15°, −7.5°, −3.75°, 0°, or, after changing the positions of the reversing switches 95 and 96, phase shifts of 0°, +11.25°, 15°, +22.5°, +26.25°, and +30°.

The phase shifts of −15°, −3.75°, +11.25°, +15°, and +26.25° require the use of differential thyristor firing. For example, using the phase A illustration, a −15° phase shift is obtained by providing a current path through valve 83, coil segments 35*a* and 36*a*, valves 89 and 88, with the reversing switches 95a and 96*a* set as shown in solid lines in FIG. 5; whereas, a +15° phase shift is obtained using the same valves and coil segments, except the reversing switches 95*a* and 96*a* are set in the dashed positions shown in FIG. 5 to couple the A node 24 with conductors 97*a* and 98*a*.

For non-differential firing, the phase shift angle depends upon the turns ratio of the transformer unit 18, and the relative location of the taps 39 and 39'. For example, to obtain the −7.5° phase shift, the phase A line current flows through valves 84 and 86, coil segment 36*a*, diverter switches 95*a* and 96*a* as shown in the solid line positions, coil segment 37*a*, and valves 90 and 88. For a +22.5° phase shift, the phase A line current flows through valve 83, coil segments 35*a* and 36*a*, diverter switches 95*a* and 96*a* as shown in the solid line positions, coil segment 37*a*, and valves 90 and 88.

Fifth Embodiment

Figure 6:
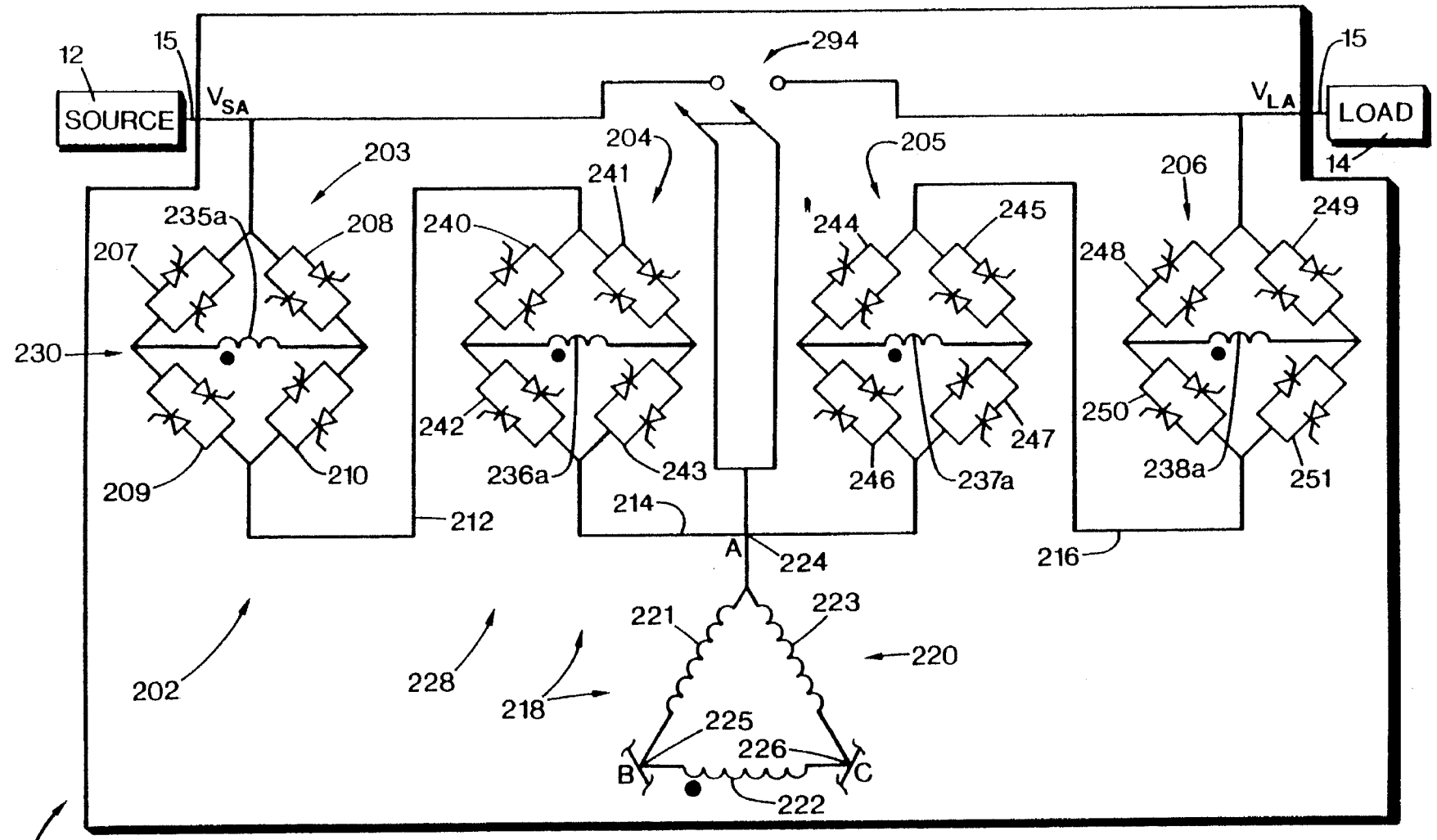
FIG. 6 is a schematic block diagram of a fifth form of a dynamic phase angle regulator system of the present invention which provides a bidirectional phase shift using electronic switching bridges.

Referring to FIG. 6, a fifth embodiment of the regulation system 198 is shown having a fifth embodiment of a dynamic phase shifter or phase angle regulator 200, constructed in accordance with the present invention. The regulator 200 is capable of providing bidirectional phase shifts between −30° and +30°. The regulator 200 may be as described above for regulator 10" of FIG. 4 as shown, or it may have a wye coupled set of exciting windings 62 as shown in FIG. 3, except that the switching assembly unit 80 has been replaced with an alternate switching assembly unit 202. For clarity, the optional conventional phase shifter 16, the controller 50, the sensors 53 and 54, the parameter setting device 57, and the reference input device 58 have been omitted from the FIG. 6 illustration, but their location and operation may be as described above.

Referring to phase A, the switching assembly unit 202 is coupled in series with the transmission line 15. The illustrated switch unit 202 has two groups of switching assemblies, with the first comprising two switching bridge assemblies 203 and 204, and the second comprising bridge assemblies 205 and 206. Each bridge assembly 203, 204, 205 and 206 has four semiconductor switch devices in a bridge arrangement, with each bridge having a source side and a load side. For example, the switch assembly 203 has two source side thyristor valves 207 and 208, and two load side thyristor valves 209 and 210. Each thyristor valve in the switch unit 202 comprises a pair of antiparallel thyristors, which may be as described above for valves 43–48.

The source side of bridge assembly 203 is coupled to the source side of line 15, and the load side of bridge assembly 206 is coupled to the load side of line 15. A conductor 212 couples together the respective load and source sides of bridge assemblies 203 and 204, the conductor 214 couples together the respective load and source sides of bridge assemblies 204 and 205, and the conductor 216 couples together the respective load and source sides of bridge assemblies 205 and 206. While only shown coupled to phase A, it is apparent that the switch assembly unit 202 also has assemblies (not shown) constructed as shown in FIG. 6 coupled to the phase B and C portions of line 15.

The illustrated regulator 200 has a transformer unit 218 with a balanced set of delta connected exciting windings 220, including three exciting windings, specifically the line-to-line AB, BC and CA windings 221, 222 and 223. The exciting windings 221, 222 and 223 are coupled together at phase A, B and C nodes 224, 225 and 226, as shown in FIG. 6. The phase A switch assembly conductor 214 is coupled to the phase A node 224.

The transformer unit 218 has a balanced set of regulating windings 228 comprising phase windings, such as the phase A regulating winding 230. Each phase of the regulating windings, is separated into four coil segments for coupling with the switch assembly 202. For instance, the phase A regulating winding 230 has four coil segments 235*a*, 236*a*, 237*a*, and 238*a*. The coil segment 235*a* is coupled within the switch bridge assembly 203, segment 236*a* is received within bridge assembly 204, segment 237*a* is received within bridge assembly 205, and segment 238*a* is received within the switch bridge assembly 206. The coil segments may be wound as described above for the transformer 18. For clarity, the coil segments 235–238 have not been separately shown for the phase B and C regulating windings (not shown) although it is apparent they may be constructed as shown for phase A.

In the illustrated embodiment, for a 150 MVA, 753 Amp source, and a 115 kV, 86 MVA short time rated exciting transformer 218, the thyristors of the switch unit 202 may be rated at 153 kV for a total of 8.0 p.u., 753 Amps short time and 409 MVA short time. The thyristors of bridge assemblies 203 and 206 are rated at 0.75 p.u., whereas the thyristors of bridge assemblies 204 and 205 are rated at 0.25 p.u.

The illustrated regulator 200 of FIG. 6 is capable of high speed bi-directional polarity without the need for differential thyristor firing. The bridge arrangement of switch unit 202 enables current to flow in either direction through each regulating coil segment such that the voltage induced in the regulating winding may be positive or negative with respect to the source voltage, $V_{SA}$. To illustrate the operation of regulator 200, the thyristor valves for the remaining bridge assemblies are assigned item numbers as follows: bridge 204 has valves 240, 241, 242 and 243; bridge 205 has valves 244, 245, 246 and 247; and bridge 206 has valves 248, 249, 250 and 251.

The regulator 200 can provide phase shifts of 0°, ±3.75°, ±7.5°, ±11.25°, ±15°, ±18.75°, ±22.5°, ±26.25°, and ±30°. For example, a +15° phase shift in phase A is obtained by providing a current path through valves 207, coil segment 235*a*, valve 210, conductor 212, valve 240, coil segment 236*a*, valve 243, conductor 214, valves 246 and 244, conductor 216, and valves 250 and 248. In contrast, a −15° phase shift is obtained by reversing polarity across the regulating windings. For a −15° phase shift, the a current path extends through valve 208, coil segment 235*a*, valve 209, conductor 212, valve 241, coil segment 236*a*, valve 242, conductor 214, valves 246 and 244, conductor 216, and valves 250 and 248.

The magnetic coupling of the set of regulating windings 228 with the set of exciting windings 220 is illustrated for phase A of the regulating windings using conventional dot notation. The phase BC exciting winding 222 is magnetically coupled to the phase A regulating winding segments 235*a*, 236b, 327*a* and 238*a*. The heavy black dots located adjacent the B phase end of the phase BC exciting winding 222, and adjacent the first ends of the coil segments 235*a*, 236*a*, 237*a* and 238*a*, indicate that these windings are wound around one of the core elements so these ends share the same instantaneous polarity. For example, current passing through the BC exciting winding 222 induces a voltage in the regulating winding. The induced voltage is proportional to the turns ratio between winding 222 and the coil segment(s) 235*a*, 236*a*, 237*a* and/or 238*a* through which the phase A line current is switched to flow, as described further below.

To remove the regulator 200 from the line during steady state conditions, while maintaining the flow of excitation current to the transformer unit 218, the regulator 200 may include an optional bypass switching device or switch 294, which may be a conventional mechanical switch, as described above for switch 94 of FIG. 4.

Operational Concepts

In operation, the dynamic phase angle regulators 10, 10', 10", 10''' and 200, referred to collectively in this section as "dynamic regulator 10" unless specified otherwise, enhance the transient stability of a power transmission system by regulating the voltage phase shift. When a transient disturbance occurs on the transmission line 15, the power flow may oscillate at about one to two Hertz (Hz). Additionally, mechanical oscillations of generating stations may introduce subsynchronous oscillations of about 15 to 20 Hz in the transmission system. When power flow oscillates in this manner, the dynamic regulator 10 damps the first swing in power flow, and thereafter the impedance of the system damps out the remaining oscillations. The first swing is damped by the dynamic regulator 10 injecting a phase shift into the transmission line after the disturbance has occurred. By altering the phase shift of the voltage, the power flow may be effectively and quickly controlled to return the system to normal.

The dynamic regulator 10 injects a phase shift by injecting a voltage displaced in phase with the voltage $V_{SA}$ of the transmission line 15. Generally, the injected voltage is a discrete quadrature voltage, meaning that it is 90 degrees out of phase with the transmission line voltage. The phase displacement of the injected voltage depends on the connection of the exciting winding relative to the regulating winding, as described above with respect to FIG. 2. The amount of phase shift depends on the magnitude of the injected voltage, which itself, depends on the turns ratio of the exciting winding relative to the regulating winding. Almost any phase shift and voltage buck or boost is theoretically possible, but the ratings of the switches and configuration of the transformer place practical limits on the amount of phase shift that a system may produce.

The dynamic regulator 10 provides a selected phase shift using a controller 50, the switching assembly unit 40, 80, 202, and the exciting transformer unit 18, 60, 218. The controller 50 monitors power flow on the line 15 and actuates the switching assembly unit 40, 80, 202 in response to a transient disturbance on the line 15. The controller 50 receives the sensor signals 55 and 56 from the source sensor 53 and/or the load sensor 54, respectively. The controller 50 also receives a parameter setting signal 257 from the parameter setting interface device 57 and a reference input signal 258 from the reference input interface device 58. In response to a transient disturbance on the line 15, the controller 50 sends the firing control signals 51 and 52 to the thyristors in the switching assembly unit 40, 80, 200.

The control scheme includes actuating the appropriate thyristor valves to inject a discrete phase shift or phase shifts until the first swing in power is sufficiently damped. The controller 50 selectively actuates the thyristor valves coupled to the regulating coil segments to couple at least a portion of the regulating winding in series with power flow. It is apparent that, while the illustrated dynamic regulator 10 is designed for the standard balanced three phase AC transmission system, it may be easily modified and incorporated into any AC polyphase transmission system.

The amount of discrete steps and their magnitude in phase shift depends, in part, on the number of taps along the regulating winding. The various taps allow the regulator to effectively vary the turns ratio between the exciting winding and the regulating winding. Using the controller 50 to vary the current routing and the timing of the current flow through the switching unit 40, 80, 200, and the corresponding regulating coil segments, a selected phase shift, and/or a selected voltage boost or buck may be imparted to the line 15. To inject a phase shift with negligible boost or buck in voltage, symmetric sections of regulating windings on the side of the source 12 and the side of the load 14 are fired.

Referring for example, to the FIG. 1 embodiment, virtually no voltage buck or boost occurs when valves 43 and 48 are fired together, and when valves 44 and 47 are fired together, because the injected voltage is primarily in quadrature to the phase voltage. Differential firing of the thyristor valves on the source and load side, however, enables the regulator to provide voltage buck and boost in addition to phase shift. For example to produce a voltage boost in addition to the phase shift, firing thyristor valve 43 in combination with the bypass thyristor valve 46 injects approximately one-half the rated phase shift of the transformer plus a component of injected voltage that is in phase with the phase voltage. A voltage buck may be produced using the regulators 10' or 10" of FIGS. 3 or 4 to change the polarity of the regulating windings with respect to the exciting winding as described below.

In general, the regulators 10''' and 200 may provide bi-directional phase shift because they include switching devices to change the polarity of the regulating windings. When the direction of current through the regulating winding is inverted, using either the mechanical diverter switches 95 and 96 shown in FIG. 5 or the switching bridges 203–206 shown in FIG. 6, the voltage injected is inverted (shifted 180° with respect to the phasor $V_{BC}'$ in FIG. 2). The injection of an inverted voltage produces a phase shift in the opposite direction.

The regulator 10 can provide both vernier phase angle control, and what is commonly referred to as "bang-bang control." In a bang-bang control scheme, the thyristor valves coupling the regulating winding to the transmission line conduct for a full cycle. Bang-bang control provides phase shift in discrete steps. To provide vernier phase angle regulation, the thyristors conduct for a fraction of a cycle to produce a phase shift that relates to the amount of time that the thyristor is fired. Vernier control provides a phase shift at any level between zero and the maximum phase shift of the regulator. To implement either of these control schemes, the controller 50 is programmed accordingly in a manner well known to skilled in the art.

The basic operational concept of the dynamic regulator 10 is to rapidly inject a voltage in series with the transmission system voltage. The injected voltage is usually in quadrature to the phase voltage to provide the largest possible phase angle shift across the phase shifting transformer 18. The phase shift introduced to the power system modifies the power transfer equation, and the resultant power flow through the regulator, as follows:

$$P=(V_s V_L \div X)\sin(\phi \pm \alpha)$$

where $\propto$ is the phase shift angle, $\phi$ is the phase difference between the $V_s$ source voltage and the $V_L$ load voltage, and X is the impedance of the line 15 between the source 12 and the load 14.

Figure 7:
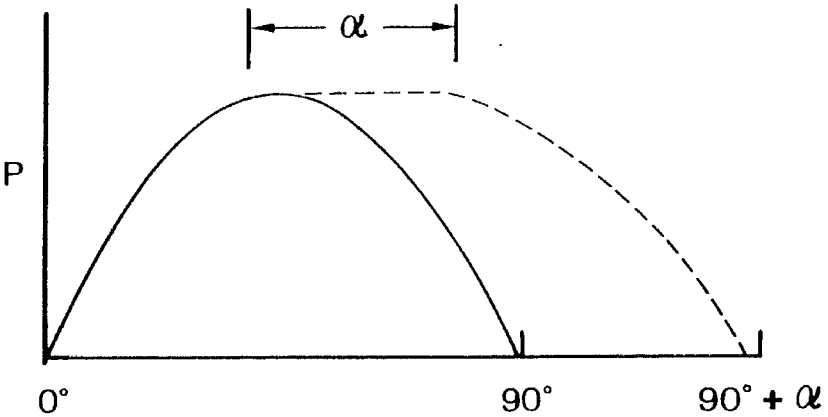
FIG. 7 is a graph of the system power transfer curve illustrating a phase shift induced using the dynamic phase angle regulator of the present invention.

The fast regulation capability can contribute dynamic regulation that will act to improve system stability margins. This role is quite different from the role normally used for conventional phase shifters, such as controlling loop flows, loadings on parallel lines, etc. This effect can be shown graphically by plotting the power transfer P versus the phase angle from the receiving end at source 12 to the sending end at load 14 as shown in FIG. 7. The addition of the rapid phase shift "α" has the effect of increasing the area under the power transfer curve by extending it by an amount equivalent to the phase shift angle "α." Viewing the benefit under an equal area criteria, the additional phase shift contributes more area under the curve which allows a larger system swing to occur before reaching a point of instability. The ability to rapidly insert in either a "+α" (boost) or as a "−α" (buck) allows the static phase shifter to modulate the power system swing on both the acceleration and deceleration phases of the swing. This is done by controlling the static phase shifter to buck or boost phase angle at the appropriate points of the power system swing.

Any phase shifter uses the principle of a transformed quadrative voltage injection to the system voltage to achieve a shift in phase angle between the input and output terminals of the transformer device. Conventional phase shifters have existed for many years and have evolved to applications in size ranges in North America to 575 MVA and 345 with on-load phase angle regulation ranges of ±25°. Sizes of conventional phase shifters are limited by the combination MVA rating and phase angle regulation range due to present mechanical load tap changer ("LTC") technology. Often trade-offs between MVA and phase angle range are made to keep the design within component capabilities or equipment cost constraints. The 300 MVA, ±30° design barrier is often caused by the current carrying and voltage per tap capability limitations of the mechanical load tap changers. Paralleling tap changers can be done in some cases to exceed these size constraints, but the mechanical tap changers are still subject to high losses and slow response capabilities.

Phase shifting transformers are rated on their output volts amperes (line-to-ground voltage x line current), the same as autotransformers. However, the equivalent volt-amperes is somewhat different from the output volt-amperes because it is also a function of the phase shift angle. This relationship is given as follows:

$$\text{Equivalent } VA = 2\left\{\sin\frac{\alpha}{2}\right\}\{\text{output } VA\}$$

$\alpha$= phase shift angle

This relationship dictates an increase in Equivalent VA size for an increase in the phase shift angle.

Conventional phase shifters generally fall in the price range of $10 to $20 per kVA purchase price. Static phase shifters will no doubt cost more than conventional ones. Hardware concepts for a static phase shifter have not received much attention, though it could be argued that already available back-to-back HVDC systems constitute the "ultimate static phase shifter." The HVDC alternative offers the full range of phase angle adjustment and power flow controllability across the interface as well as the desired dynamic regulation attributes. However, prices for back-to-back HVDC systems generally range in the neighborhood of $150 per kVA. Therefore, it should be recognized that practical static phase shifter designs, in order to be competitive should be priced well below this cost threshold. For example, the regulators of FIGS. 3–6 are expected to cost on the order of $50 to $100 per kVA.

Having illustrated and described the principles of the invention in a preferred embodiment, it should be apparent to those skilled in the art that the invention can be modified in arrangement and detail without departing from such principles. For example, other types of switches, such as gate turn off thyristors (GTO's), metal oxide silicon field effect transistors (MOSFET's), insulated gate bipolar transistors (IGBT's) and the like, may be substituted for the illustrated thyristor values, particularly, if they prove more cost efficient for some implementations. Other structurally equivalent arrangements for the switch assemblies known to those skilled in the art may be substituted for those illustrated herein. For example, while the switching units 40 and 80 of FIGS. 1, 3 and 4, 5, respectively, are each illustrated as having a pair of switch assemblies, they could also be constructed using only one switch assembly, particularly if voltage buck or boost can be tolerated by the power system. The FIG. 6 regulator 200 can be similarly modified by eliminating either bridge assemblies 203 and 204, or assemblies 205 and 206. Such embodiments provide a regulator which is more economical yet than units 40, 80 and 202 because fewer regulating coil segments and fewer semiconductor switches are used. I claim all modifications and equivalents falling within the spirit and scope of the following claims.

I claim:

1. A dynamic phase angle regulator for regulating power flow through a polyphase AC power line having one line per phase, comprising:

a transformer unit having a polyphase core with a core element per phase, a regulating winding, and an exciting winding connected to a first line of the AC power line, with the regulating winding and the exciting winding being wound around a first core element; and a switching assembly connected to the regulating winding to selectively electrically connect the regulating winding in series with a second line of the AC power line to inject a regulating voltage in the second line; wherein the regulating winding comprises first and second coil segments joined in series at an intermediate tap, the first coil segment having a first end opposite the tap, and the second coil segment having a second end opposite the tap; and the switching assembly includes a first switching device to selectively electrically connect the AC power line to the first end of the first coil segment, second and third switching devices joined together at a switch node to selectively electrically connect the AC power line to the second end of the second coil segment, a fourth switching device to selectively electrically connect the tap to the AC power line through the second switching device.

2. A phase angle regulation transformer for a polyphase power system including a first power system phase and a second power system phase, comprising:

a regulating winding;

an exciting winding connected to said first power system phase;

a single core magnetically connecting said exciting winding and said regulating winding; and a switching assembly connected between said second power system phase and said regulating winding to selectively connect said regulating winding in series with said second power system phase and thereby inject a regulating voltage into said second power system phase, wherein said regulating winding comprises first and second coil segments joined in series at an intermediate tap, said first coil segment having a first end opposite said tap, and said second coil segment having a second end opposite said tap; and said switching assembly comprises a first switching device to selectively electrically connect said second power system phase to said first end of said first coil segment, second and third switching devices joined together at a switch node to selectively electrically connect said second power system phase to said second end of said second coil segment, a fourth switching device to selectively electrically connect said tap to said switch node to selectively connect said tap to said second power system phase through said second switching device.

3. The apparatus of claim 2 further comprising a controller connected between said polyphase power system and said switching assembly to sense a disturbance on said polyphase power system and to generate a switching signal for said switching assembly such that said regulating winding is connected to said second power system phase in such a manner as to damp said disturbance.

4. The apparatus of claim 2 wherein said transformer includes three exciting windings connected in a delta configuration, with two exciting windings connected at said first node.

5. The apparatus of claim 2 wherein said transformer includes three exciting windings connected in a wye configuration to join at a neutral node, with one exciting winding connected to said first node.

* * * * *